United States Patent [19]

Castoe

[11] 4,372,023

[45] Feb. 8, 1983

[54] VALVE ADJUSTMENT APPARATUS

[76] Inventor: John H. Castoe, 10234 McVine St., Sunland, Calif. 91040

[21] Appl. No.: 209,676

[22] Filed: Nov. 24, 1980

[51] Int. Cl.[3] ..... B23P 19/04

[52] U.S. Cl. ..... 29/256; 29/266

[58] Field of Search ..... 29/213, 215, 218, 219, 29/156.4 R, 156.7 B, 156.7 R, 239, 256, 266; 269/91, 93

[56] References Cited

U.S. PATENT DOCUMENTS 3,979,811 9/1976 Kammeraad ..... 29/215

4,158,318 6/1979 Strametz ..... 29/256

*Primary Examiner*—James L. Jones, Jr.

*Attorney, Agent, or Firm*—Christie, Parker & Hale

[57] ABSTRACT

Apparatus for removing a valve adjusting disc from a valve lifter in a valve mechanism of an engine cylinder head includes an elongated rigid cross-bar supported on the engine cylinder head and extending generally parallel to the camshaft above the valve lifters. A force-applying member slides on the cross-bar and is straddled by an adjustment screw retainer that also slides on the cross-bar. The force-applying member has a downwardly extending arm with a lower working face that contacts the valve lifter independently of contact with the valve adjustment disc. An adjustment screw carried on the retainer is turned to apply downward force on the force-applying member, which forces the arm downwardly against the resistance of the cross-bar for compressing the valve lifter against the bias of the valve spring. This moves the valve lifter downwardly away from the valve adjustment disc, while the valve lifter is retained in its compressed position, so the valve clearance can be measured and the valve adjustment disc can be removed from the valve lifter, if desired.

16 Claims, 6 Drawing Figures

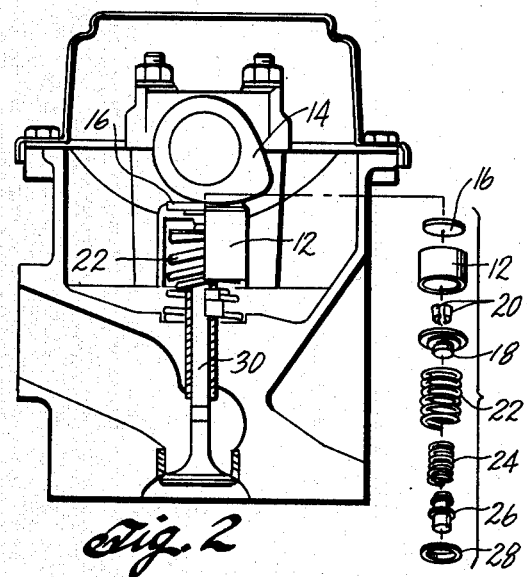
Fig. 2
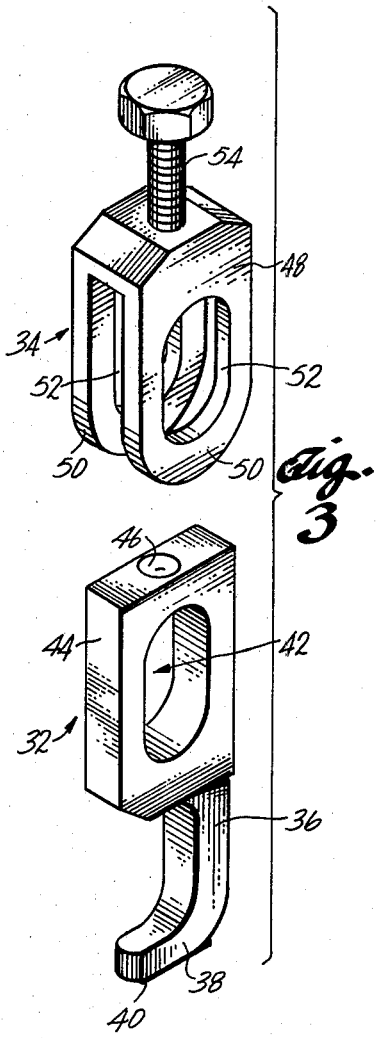
Fig. 3
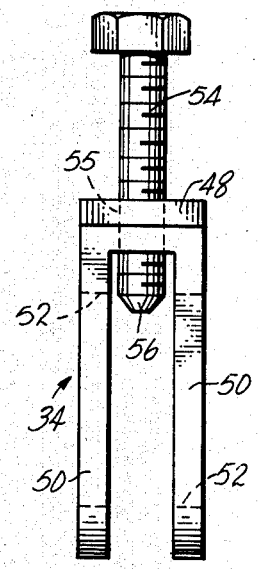
Fig. 4
Fig. 5
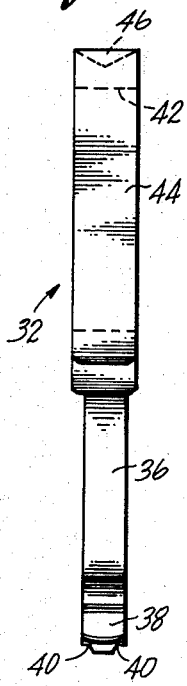
Fig. 6
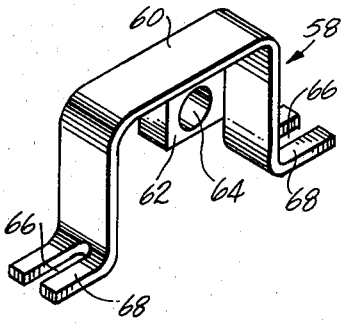

VALVE ADJUSTMENT APPARATUS

BACKGROUND OF THE INVENTION

1. Field of the Invention

This invention relates to valve adjustment apparatus for use in removing a valve adjustment disc from a valve lifter in a valve mechanism of an engine cylinder head.

2. Description of the Prior Art

The job of adjusting the valves of an automobile engine can be time-consuming and costly to the automobile owner. On certain types of engines the job is tedious because of the lack of available tools to aid the mechanic in adjusting the valves in a reasonable amount of time. For example, certain overhead cam engines manufactured by Volkswagen and Audi and other similar engines manufactured in Japan for Crysler have mechanical valve lifters above the valves. The valve lifters carry shims or "valve adjustment discs" of selected thickness for use in making the correct valve adjustment for each valve. The valve lifters in these engines are cup-shaped and the interior of the cup faces downward and fits over the valve. A separate shim is seated in a recess in the top of each valve lifter. The lobes of the camshaft contact the top surfaces of the shims during operation of the engine.

To make a valve adjustment, the mechanic uses a feeler gauge to measure the clearance between the shim and the cam lobe; and if adjustment is required, the shim is removed from the valve lifter and another shim of different thickness is inserted in the lifter to provide the correct clearance adjustment.

Valve adjustments in these engines are most commonly done by using a tool for compressing the valve lifter against the bias of the valve spring to move the valve lifter down relative to the shim. The shim can then be removed. The downward force of the tool against the valve lifter is maintained by forcing the tool against the side of the camshaft, using the cam shaft as a fulcrum to apply the downward pressure for compressing the valve against the valve spring. Such use of the camshaft body as a pressure point for applying sufficient force to compress the valve lifter could damage the camshaft. The valve springs are very stiff and require a substantial amount of force for the mechanic to hold the valve lifter down with one hand while using the other hand to remove the shim from the valve lifter. It is not easy to remove the shim from the lifter in this way because the shim is tightly seated in the valve lifter even when the valve lifter is compressed.

The present invention provides apparatus for removing the shims from the valve lifters, so that the valve lifters can be compressed against the valve springs and held in a compressed position without contacting the camshaft, or any other critical moving part of the automobile engine. The apparatus of this invention facilitates quick and easy removal of all shims from the valve lifters, since the mechanic has both hands free to remove the shims. This can provide a substantial reduction in the amount of time required to perform a valve adjustment.

SUMMARY OF THE INVENTION

Briefly, one embodiment of the present invention provides apparatus for removing a valve adjusting disc from a valve lifter in a valve mechanism of an overhead cam engine, in which the valve lifter bears against a spring-biased valve, and the valve adjusting disc is seated in the valve lifter. The apparatus includes an elongated cross-bar supported in a fixed position above the valve lifter. A force-applying arm has a working face for contacting the valve lifter essentially independently of contact with the valve adjusting disc. The arm cooperates with the cross-bar for holding the working face of the arm in contact with the valve lifter. An adjustable amount of force is applied to the arm against the resistance provided by the cross-bar to force the working face of the arm against the valve lifter for compressing the valve lifter relative to the valve adjustment disc. The force of the arm on the valve lifter can be retained against the bias of the valve spring while the disc is removed from the valve lifter. Such force is applied independently of contact with the camshaft.

In one form of the invention, the force-applying arm is slidable lengthwise along the cross-bar and is rotatable relative to the cross-bar so that the arm can be used to compress the valve lifter for removal of the disc, and then rotated away to clear the camshaft, and then moved to another position on the cross-bar where the arm can be rotated into position for adjusting the next valve.

These and other aspects of the invention will be more fully understood by referring to the following detailed description and the accompanying drawings.

DRAWINGS

FIG. 2 is a semi-schematic end elevation view, partly in cross-section and partly exploded, illustrating a valve mechanism on which the apparatus of this invention can be used;

FIG. 3 is an exploded perspective view showing a force-applying arm and an adjustment screw retainer according to principles of this invention;

FIG. 4 is an end elevation view taken on line 4—4 of FIG. 3;

FIG. 5 is an end elevation view taken on line 5—5 of FIG. 3; and

FIG. 6 is a perspective view showing a bracket for supporting a cross-bar for holding the valve adjustment apparatus of this invention.

DETAILED DESCRIPTION

Figure 1:
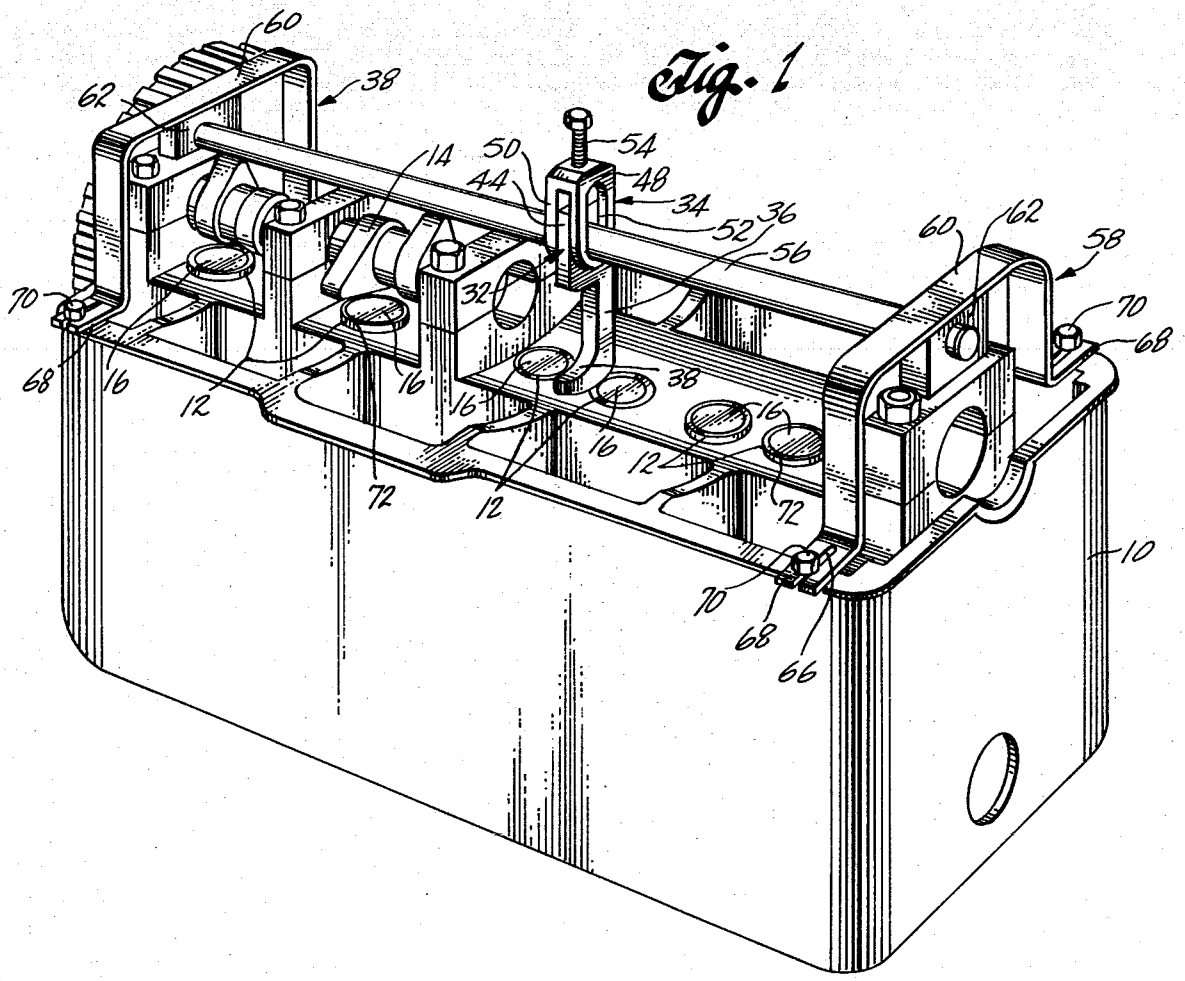
FIG. 1 is a perspective view showing the apparatus of this invention in use compressing a pair of adjacent valve lifters in preparation for removing their valve adjustment discs.

FIG. 1 shows valve adjustment apparatus of this invention being used to adjust the valves in a valve system of an overhead cam engine. The engine has an engine cylinder head 10 and mechanical valve lifters 12 arranged in pairs along the length of the cylinder head. The lobes of a camshaft 14 (partly broken away for clarity in FIG. 1) bear directly on the top faces of removable shims or "valve adjusting discs" 16 carried in the tops of the valve lifters.

FIG. 2 illustrates the valve system on which the apparatus of this invention is used. The valve lifters 12 are shaped as a cup with a downwardly facing hollow interior that fits over a valve 18. The lifter bears directly on top of valve tips 20. The valve system includes the usual outer and inner valve springs 22 and 24, a valve stem seal 26, a valve spring seat 28, and a valve guide 30. During operation of the engine, the lobes of the camshaft bear against the valve adjustment discs in the tops of the valve lifters to compress the valves against the valve springs.

To adjust the valve clearance, the spacing between each lobe of the camshaft and the top of the corresponding valve adjustment disc is measured. The mechanic rotates the camshaft prior to making each valve clearance measurement. If adjustment is necessary, the camshaft is then rotated to rotate the cam lobe away from the vicinity of the adjustment disc of the valve being adjusted. The mechanic then removes the adjustment disc from the top of the valve filter so the disc can be replaced with another disc which provides the correct valve clearance. The valve lifter is normally held tightly around the exterior of the disc when under the influence of the valve spring. To remove the disc requires compressing the valve lifter against the stiff bias of the valve spring to move the valve lifter down away from its position around the adjustment disc sufficiently so that the disc can be removed from its captive position in the valve lifter. A special tool or a magnet is needed to remove the disc even when the valve lifter around it is compressed.

FIGS. 3 through 5 illustrate components of apparatus for compressing the valve lifter against the bias of the valve spring for use in removing the valve adjustment disc. The apparatus includes a force-applying member 32 and a cooperating adjustment screw retainer 34. The force-applying member includes an elongated, generally L-shaped rigid force-applying arm 36 having a foot 38 at its bottom. A pair of generally parallel, elongated grooves 40 in the underside of the foot extend along opposite lower corners of the foot. The bottom of the foot is the working face of the force-applying arm, and the bottom of the foot is shaped to fit between each pair of adjacent valve lifters 12 on the engine 10. The top edges of the grooves in the foot 38 simultaneously overlie adjacent top edges of each pair of valve lifters. The foot is narrow enough so that it contacts the adjacent top edges of each pair of valve lifters without making any significant contact with the valve adjusting discs seated in the top portions of the valve lifters.

The force-applying member includes a socket extending above the force-applying arm. The socket has an opening 42 which is elongated, with a long dimension of the opening extending in the same general direction as the length of the force-applying arm. The opening 42 passes through a narrow rectangular body 44 of the socket. A recess 46 is formed in a top edge of the body forming the socket.

As shown best in FIG. 4, the adjustment screw retainer 34 has an inverted U-shaped body 48 with opposite narrow depending legs 50. The legs 50 are spaced apart by a distance substantially equal to the width of the socket of the force-applying arm so that the socket can slip into the space between the legs 50. Elongated openings 52 extend through the legs of the retainer. These openings are approximately the same size and shape as the opening 42 in the socket of the force-applying member. The openings 52 are aligned with one another so that when the body 44 of the socket is inserted into the space between the two legs of the retainer, the two openings 52 and the opening 42 can be aligned with one another. The upper bight portion of the body 48 carries an adjustment screw 54 threaded into an internally threaded bore 55 that passes entirely through the bight portion of the retainer. By turning the adjustment screw about its axis, the lower portion of the adjustment screw can travel downwardly in the space between the legs 50 of the retainer. With the socket in place between the legs 50 of the retainer, a tapered bottom 56 of the adjustment screw engages the recess 46 in the top edge of the socket.

The valve adjustment apparatus also includes an elongated rigid cross-bar 56 of circular cross-section adapted for mounting above the engine cylinder head as illustrated in FIG. 1. The cross-bar is supported above the cylinder head by a pair of inverted U-shaped brackets 58 mounted to opposite ends of the cylinder head. As shown best in FIG. 6, each bracket has a cross-member 60, a block 62 centered on the underside of the cross-member, a circular bore through each block for slidably receiving corresponding end portions of the cross-bar, and slots 66 formed in separate outwardly projecting feet 68 at the base of the legs on opposite sides of the bracket. As shown best in FIG. 1, the brackets are secured to opposite ends of the engine cylinder head by bolts 70 extending through the slots in the base of the bracket. As shown best in FIG. 1, the brackets are secured to opposite ends of the engine cylinder head by bolts 70 extending through the slots in the base of the bracket. This places the blocks 62 above the central axis of the cylinder head so that the cross-bar can be slipped into the bore in each block for holding the cross-bar in a fixed position above the row of valve lifters, which are also aligned generally along the axis of the cylinder head.

As shown best in FIG. 1, the valve adjustment apparatus is used by first attaching the brackets to the engine cylinder head. One end of the cross-bar is then slipped into the bore in the block of one bracket. The body 44 of the force-applying member 32 is then inserted into the space between the legs 50 of the adjustment screw retainer 34 so the opening 42 in the socket is aligned with the openings in opposite legs of the retainer. The free end of the cross-bar is then slipped through the aligned openings in the retainer and the socket, and then the free end of the cross-bar is inserted in the bore in the block of the bracket at the other end of the cylinder head. The cross-bar can be long enough so that protruding end portions of the cross-bar extend past the outer ends of the blocks of the brackets. Keys or cotter pins (not shown) can then be inserted in the protruding end portions of the cross-bar to hold the cross-bar in a fixed position above the valve lifters.

The force-applying member and the adjustment screw retainer are both able to slide in unison along the length of the fixed cross-bar. Owing to the passages in the force-applying member and the adjustment screw retainer being elongated in a direction perpendicular to the axis of the cross-bar, each member can move perpendicular to the axis of the cross-bar toward or away from the valves. The adjustment screw 54 is initially loosened so the force-applying member can rotate about the axis of the cross-bar relative to the adjustment screw retainer. In this way, the force-applying arm can be rotated upwardly away from the valves to allow the force-applying arm to clear the cylinder head so the force-applying member can slide along the cross-bar to a selected position above the valves to be adjusted. The force-applying arm then can be rotated down to place the working face of the foot of the force-applying arm in its working position between a pair of valve lifters, as illustrated in FIG. 1. In this position, the grooves on opposite sides of the foot rest on adjacent inside edges of the two valve lifters in each pair of valve lifters, without making contact with the valve adjustment discs in the valve lifters. The adjustment screw is then tightened by turning it so that the bottom of the screw is forced down against the top of the socket of the force-applying member. The top of the adjustment screw holder is held in a fixed position above the cross-bar by the resistance of the rigid cross-bar against the bottom portions of the openings in the adjustment screw retainer. By so maintaining the top of the adjustment screw retainer in a fixed position and tightening the adjustment screw, the distance between the top of the force-applying member and the underside of the bridge at the top of the adjustment screw retainer is increased, thereby forcing the force-applying arm down on the upper edges of the two valve lifters. This compresses the valve lifters relative to their respective valve adjustment discs, which releases the grip on the discs sufficiently to allow them to be removed from the tops of the valve lifters. FIG. 1 shows the pair of valve lifters being compressed relative to the discs, while the other valve lifters are in their normal raised positions under the bias of the valve springs. Slots 72 in opposite sides of each valve lifter can facilitate placing a tool under the disc, once the valve lifter is compressed, for removing the disc; or a magnet can be used to remove the disc. The force-applying arm applies a substantial amount of force to the valve lifters against the strong bias of the stiff valve springs. The force-applying arm maintains a downward force on the valve lifters, keeping them compressed until the valve adjustment screw is turned to release the downward force. The valve adjustment apparatus also can maintain this compressive force against the valve lifters independently of contact with the camshaft, and it allows the mechanic to have both hands free to make the valve clearance measurement, to remove the adjustment discs, and to replace the discs with different sized discs, if necessary. The force-applying member can be released by loosening the adjustment screw. The screw can be loosened sufficiently to allow the force-applying arm to be rotated away from the valve lifters and slid along the length of the cross-bar, along with the adjustment screw retainer, to the next position for making the valve adjustment for the next pair of valves.

I claim:

1. Apparatus for removing a valve adjusting disc from a valve lifter in the valve mechanism of an engine cylinder head, in which the valve lifter bears against a spring-biased valve, and the valve adjusting disc is seated in the valve lifter, the apparatus comprising:

an elongated rigid cross-bar;

means for supporting the cross-bar in a fixed position above the valve lifter;

a force-applying member having an elongated force-applying arm with a working face for contacting the valve lifter and having a socket for slidably engaging the cross-bar for cooperating with the cross-bar for holding the working face of the force-applying arm in a working position in contact with the valve lifter independently of contact with the valve adjusting disc, the socket allowing the force-applying arm to move freely along the length of the cross-bar, to move up and down relative to the cross-bar, and to rotate relative to the cross-bar; and force-applying means for slidably engaging the cross-bar for being movable freely along the length of the cross-bar, the force-applying means having an adjustment screw for applying an adjustable amount of force to the socket of the force-applying member against the resistance provided by the attachment of the force-applying means to the fixed cross-bar and for retaining said force to compress the working face of the force-applying arm against the valve lifter for moving the valve lifter downwardly relative to the valve adjusting disc to a compressed position in which the valve lifter is retained by the force-applying arm.

2. Apparatus according to claim 1 in which the socket holds the force-applying arm captive on the cross-bar.

3. Apparatus according to claim 2 in which the socket has an opening which is elongated for allowing the force-applying arm to travel along an axis that intersects the longitudinal axis of the cross-bar in addition to the socket traveling along the length of the cross-bar and being rotatable about the cross-bar.

4. Apparatus according to claim 3 in which the force-applying means includes a body which is releasably secured to the cross-bar, and the adjustable force-applying screw is carried on the body.

5. Apparatus according to claim 4 in which the body of the force-applying means straddles the socket and is slidably engaged with the cross-bar.

6. Apparatus for removing a valve adjusting disc from a valve lifter in a valve mechanism of an engine cylinder head, in which the valve lifter bears against a spring-biased valve, and the valve adjusting disc is seated in the valve lifter, the apparatus comprising:

an elongated cross-bar;

a bracket for supporting the cross-bar in a fixed position spaced above the valve lifter;

an elongated force-applying member having an arm with a working face for contacting the valve lifter and having a socket spaced from the working face of the arm for being slidably secured to the cross-bar for holding the working face of the arm adjacent the valve lifter, the socket permitting transverse movement of the arm relative to the cross-bar for moving the arm downwardly away from the cross-bar and toward the valve lifter;

a retainer sleeve for being slidably secured to the cross-bar adjacent the force-applying member for holding the socket of the force-applying member in a fixed position on the cross-bar; and an adjustable screw carried on the retainer sleeve for engagement with the socket of the force-applying member, the adjustment screw being movable into contact with the socket for applying an adjustable amount of force to the arm against the resistance provided by the attachment of the retainer sleeve to the cross-bar for forcing the working face of the force-applying arm downwardly away from the cross-bar and against the valve lifter for moving the valve lifter relative to the valve adjusting disc.

7. Apparatus according to claim 6 including means for retaining the force of the adjustment screw on the socket.

8. Apparatus according to claim 6 in which the socket is slidable lengthwise on the cross-bar and is rotatable about the cross-bar.

9. Apparatus according to claim 8 in which the retainer sleeve is slidable lengthwise on the cross-bar.

10. Apparatus according to claim 9 including means for releasably securing the cross-bar to the bracket.

11. Apparatus according to claim 6 in which the retainer sleeve straddles the socket of the force-applying member and is slidably engaged with the cross-bar.

12. Apparatus according to claim 6 in which the force-applying arm is generally L-shaped, having a leg extending downwardly and being offset with respect to the socket and having a foot projecting to one side of the leg below the socket.

13. Apparatus according to claim 12 in which the retainer sleeve straddles the socket of the force-applying member and is slidably engaged with the cross-bar.

14. Apparatus according to claim 1 in which the force-applying arm is generally L-shaped, having a leg extending downwardly and being offset with respect to the socket and having a foot projecting to one side of the leg below the socket.

15. Apparatus according to claim 14 in which the body of the force-applying means straddles the socket and is slidably engaged with the cross-bar.

16. Apparatus for removing a valve adjusting disc from a valve lifter in the valve mechanism of an engine cylinder head, in which the valve lifter bears against a spring-biased valve, and the valve adjusting disc is seated in the valve lifter, the apparatus comprising:

an elongated rigid cross-bar;

means for supporting the cross-bar in a fixed position above the valve lifter;

a force-applying member having an elongated force-applying arm with a working face for contacting the valve lifter and having a socket slidably engaged with the cross-bar for holding the force-applying arm captive on the cross-bar and for co-operating with the cross-bar for holding the working face of the force-applying arm in a working position in contact with the valve lifter independently of contact with the valve-adjusting disc, the socket having an opening which is elongated for allowing the force-applying arm to travel along an axis that intersects the longitudinal axis of the cross-bar in addition to the socket traveling along the length of the cross-bar and being rotatable about the cross-bar; and force-applying means having a body which straddles the socket of the force-applying member and which is slidably engaged with the cross-bar, and an adjustable force-applying screw carried on the body and positioned for contact with the socket for applying an adjustable amount of force to the socket from rotation of the force-applying screw, said force being applied against the resistance provided by the attachment of the force-applying means to the fixed cross-bar, the force-applying means and the socket cooperating for retaining said force to compress the working face of the force-applying arm against the valve lifter for moving the valve lifter downwardly relative to the valve-adjusting disc to a compressed position in which the valve lifter is retained by the force-applying arm.

* * * * *